US008613315B2

(12) United States Patent
Shako et al.

(10) Patent No.: US 8,613,315 B2
(45) Date of Patent: Dec. 24, 2013

(54) COMPLEX TOOL FOR WELL MONITORING

(75) Inventors: Valery Vasilievich Shako, Moscow (RU); Anton Vladimirovich Parshin, Moscow (RU); Rashid Kamilevich Yarullin, Ufa (RU); Rim Abdullovich Valiullin, Ufa (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 247 days.

(21) Appl. No.: 13/214,702

(22) Filed: Aug. 22, 2011

(65) Prior Publication Data

US 2012/0073802 A1 Mar. 29, 2012

(30) Foreign Application Priority Data

Aug. 23, 2010 (RU) ..... 2010134885

(51) Int. Cl.
*E21B 17/10* (2006.01)

(52) U.S. Cl.
USPC ..... 166/255.2; 166/241.6

(58) Field of Classification Search
USPC ..... 166/255.2, 241.4, 241.6
See application file for complete search history.

(56) References Cited

U.S. PATENT DOCUMENTS

| | | | | |
|---|---|---|---|---|
| 5,661,237 | A | 8/1997 | Dussan V. et al. | |
| 8,201,625 | B2 * | 6/2012 | Almaguer | 166/250.08 |

FOREIGN PATENT DOCUMENTS

| | | |
|---|---|---|
| CN | 201265407 | 7/2009 |
| RU | 21415 | 1/2002 |
| RU | 2230903 | 6/2004 |
| RU | 2303130 | 7/2007 |
| RU | 85549 | 8/2009 |
| RU | 20091004630 | 8/2010 |

OTHER PUBLICATIONS

Belyshev et al., "Multifunctional Computer-Controlled Downhole Tools or Oil and Gas Field Development Control," Research and Engineering Journal of Association for Well Geophysical Survey, Tver, 2005, Issue 111-112; pp. 1-11.

* cited by examiner

*Primary Examiner* — William P Neuder

(57) ABSTRACT

A complex tool according to the invention comprises a cylindrical housing, a lever centralizer aligning the tool along the well axis and having at least six levers and a fluid flow temperature sensor and inflow temperature indicator located on the tool axis. A fluid phase composition sensors are located on the centralizer levers and distributed along the well bore circumference. An additional fluid phase composition sensor is located on the tool axis. At least one additional fluid flow temperature sensor and at least one additional inflow temperature indicator disposed on each lever and distributed along the well bore circumference and located on the same line with the phase composition sensors parallel to the tool axis. There is an additional upper lever centralizer in the tail part.

6 Claims, 2 Drawing Sheets

COMPLEX TOOL FOR WELL MONITORING

FIELD OF THE INVENTION

Figure 1:
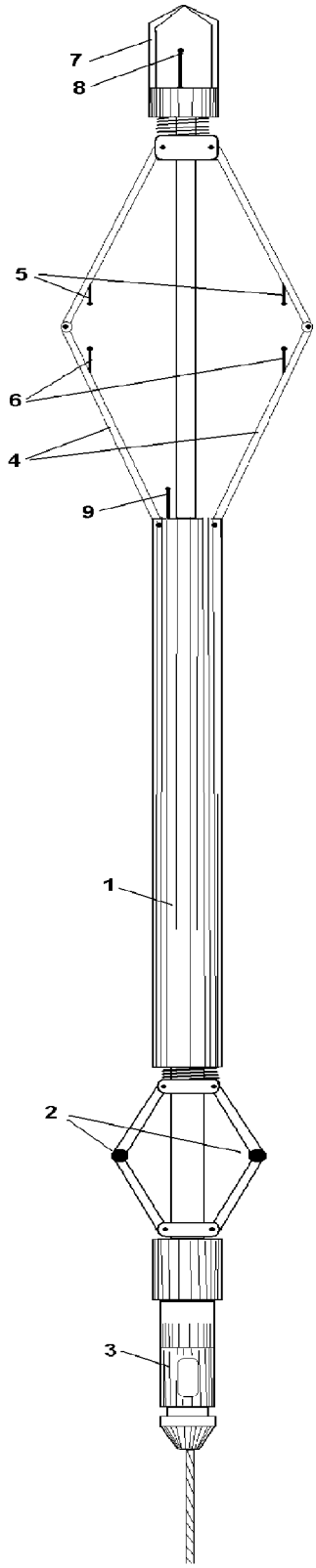

The invention is related to the area of geophysics and used for performing a series of geophysical logging of horizontal oil and gas wells, particularly, for measurement, indication, control and transmission of the wells' physical parameters to the surface.

BACKGROUND OF THE INVENTION

It is known a wireline logging device monitoring the gas wells during development and production stages (Patent RU 2230903 E 21 B 47/00), which includes a cylindrical body with a wireline connection cable on top. Housing of the device has gas axial and horizontal flowmeter, moisture meters, pressure, noise, temperature, gamma-ray and collar locator sensors, power-supply unit and electronic boards are mounted, on the housing a centralizer aligning the apparatus along the well axis is mounted.

A complex tool for monitoring horizontal wells "AGAT-KG-42" (Research and Engineering Journal of Association for Well Geophysical Survey "Karotazhnik", Tver, 2004, issue 111-112, p. 103) and its modification "AGAT KG-42 6V" lowered into the well on a special wireline and consisting of two independent modules—PM module and RVS module, is known. PM Module includes pressure, temperature, induction resistivity transducers, mechanical flow meter, collar locator and gamma-ray channel. RVS module includes a high-sensitivity flowmeter with a lever centralizer and opening meter run, inflow temperature indicator and temperature transducer mounted on the instrument axis. At the levers of the centralizer simultaneously acting as a flow conditioner six moisture sensors scanning the fluid in the horizontal well borehole in stratified flow conditions.

Disadvantage of the known devices consists in the narrow application scope due to limited functionality because in stratified flow conditions flowmeters, temperature transducers and inflow temperature indicator do not provide layer by layer temperature field and multi-phase flow dynamic parameters' scanning

SUMMARY OF THE INVENTION

The technical result of the invention consists in the improved research data quality, apparatus operation efficiency, functionality expansion in stratified flow conditions.

A complex tool according to the invention comprises a cylindrical housing, a lever centralizer aligning the tool along the well axis and having at least six levers and a fluid flow temperature sensor and inflow temperature indicator located on the tool axis. A fluid phase composition sensors are located on the centralizer levers and distributed along the well bore circumference. An additional fluid phase composition sensor is located on the tool axis. At least one additional fluid flow temperature sensor and at least one additional inflow temperature indicator disposed on each lever and distributed along the well bore circumference and located on the same line with the phase composition sensors parallel to the tool axis. There is an additional upper lever centralizer in the tail part.

The fluid phase sensors are preferably combined (mounted in the same housing) with additional temperature sensors or additional inflow temperature indicators.

The additional upper centralizer may also be equipped with sensors mounted on its levers.

DETAILED DESCRIPTION OF THE INVENTION

Figure 2:
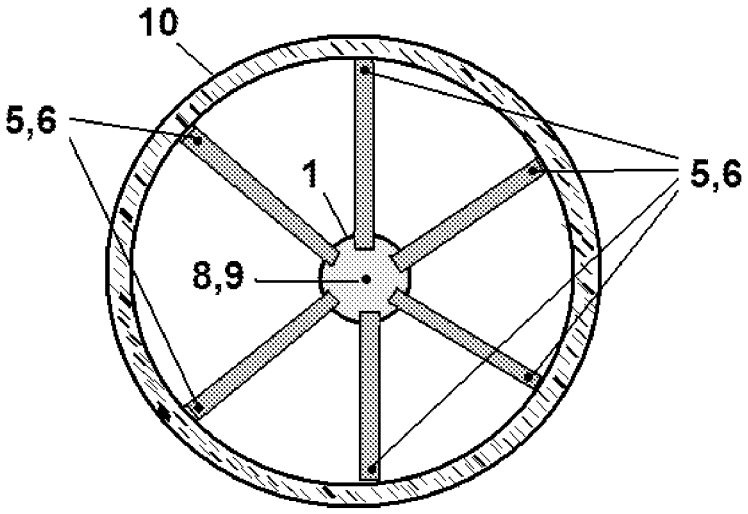

The invention is explained by the drawings where in FIG. 1 overall view of the complex tool is shown and in FIG. 2 layout diagram of the tool housing and temperature sensor, phase sensors' and inflow temperature indicators in the borehole are shown.

The complex tool is a cylindrical housing 1 in which built-in sensors are placed (collar locator CL, gamma-channel GC, pressure MN, passive multichannel sound level meter SLM, attitude determination sensors XYZ, electronic boards), upper centralizer 2 located in the tool tail part behind the plug-and-socket cable terminal 3, head centralizer consisting of at least six spring-loaded levers 4, on each lever at least one temperature sensor 5 combined with the phase sensor and at least on inflow temperature indicator 6 is mounted. Temperature indicator 6 may be combined with the phase sensor. In the nose fairing 7 axial temperature sensor 8 combined with the phase sensor is mounted and in the tool housing inflow temperature indicator 9 is mounted.

Spring-loaded levers 4 provide the tool housing 1 alignment along the axis of directional and horizontal well 10 and distribution of the temperature sensors 5 combined with the phase sensors and inflow temperature indicators 6 along the well circumference. Hereby axial sensors 8 and 9 are located along the well axis.

Additional upper centralizer 2 also may be equipped with temperature sensors, phase sensors and inflow temperature indicators mounted on its levers and distributed along the borehole circumference on the same line parallel to the tool axis, similar to the head lever centralizer.

The complex well monitoring tool operates as follows.

After the tool lowering into the survey range and bringing it to the operating status centralizers open and physical fields are recorded during the tool lowering movement. The tool position linking to the production casing cross-section and design is provided using GC and CL linking methods. Current pressure in the tool location point as of the measurement time is determined by pressure transducer MN; tool housing and active centralizer sensors' attitude determination relative to the Earth magnetic field—using attitude determination sensor XYZ. Sound level meter built into the tool housing provides hydroacoustic noise intensity measurement followed by the spectral analysis.

The group of sensors 5 and 6 mounted on levers 4 records the distribution of temperature, flow phase composition and flow velocity along the borehole circumference (FIG. 2) and axial sensors 8 and 9—on the flow axis. Attitude determination sensor linked to the position of one of the sensors from group 5, 6 provides the possibility of building temperature, phase composition and local flow velocity field along the borehole cross-section based on the Earth gravitation field using cubic spline interpolation method. Comprehensive analysis of all the parameters recorded based on the distribution of temperature, phase composition and local flow velocity fields provides the possibility of unambiguous segregation of oil or water inflow intervals in the conditions of stratified multi-phase flow in the low-yield horizontal well borehole. Inflow temperature indicators' location over the temperature sensors ensures flow temperature field not biased by the heat emission in the inflow temperature indicators during the record of the parameters in the operating well during the tool lowering. Location of the group of temperature sensors, phase sensors and inflow temperature indicators on the same line parallel to the well axis provides record of the initial flow temperature, fluid phase composition for quantitative evaluation of the local flow velocity using inflow temperature indicator.

The set of all the parameters in question is continuously transmitted to the surface recorder in online mode via a cable or stored in the tool built-in memory. Power supply of the measurement circuit and tool in general is performed via a cable or using independent power-sources. The tool transportation along the horizontal wellbore is performed using standard devices used for geophysical logging in the horizontal wells.

What is claimed is:

1. A complex tool for well monitoring comprising:

a cylindrical housing, a lever centralizer that aligns the tool along a well axis and has at least six levers, a fluid flow temperature sensor and an inflow temperature indicator located on the tool axis, fluid phase composition sensors disposed on the levers of the centralizer and distributed along the well bore circumference, an additional fluid phase composition sensor located on the tool axis, at least one additional fluid flow temperature sensor and at least one additional inflow temperature indicator disposed on each lever and distributed along the well bore circumference and located on the same line with the phase composition sensors parallel to the tool axis, and an additional upper lever centralizer in a tail part of the tool.

2. The complex tool of claim 1 wherein the at least one additional fluid flow temperature sensor is combined with the fluid phase composition sensor disposed on the levers of the centralizer.

3. The complex tool of claim 1 wherein the at least one additional inflow temperature indicator is combined with the fluid phase composition sensor disposed on the levers of the centralizer.

4. The complex tool of claim 1 further comprising temperature sensors, inflow temperature indicators and fluid phase composition sensors disposed on levers of the additional upper lever centralizer and distributed along the well bore circumference on the same line parallel to the tool axis.

5. The complex tool of claim 4 wherein the temperature sensors disposed on the levers of the additional upper lever centralizer are combined with the fluid phase composition sensors disposed on the levers of the additional upper lever centralizer.

6. The complex tool of claim 4 wherein the inflow temperature indicators disposed on the levers of the additional upper lever centralizer are combined with the fluid phase composition sensors disposed on the levers of the additional upper lever centralizer.

* * * * *